US006220071B1

(12) United States Patent
Verbickas

(10) Patent No.: US 6,220,071 B1
(45) Date of Patent: Apr. 24, 2001

(54) METHOD AND APPARATUS FOR CONTROLLING STRIP EDGE RELIEF IN A CLUSTER ROLLING MILL

(75) Inventor: Robert C. Verbickas, Wolcott, CT (US)

(73) Assignee: Mill Design & Consulting Services, LLC, Wolcott, CT (US)

( * ) Notice: Subject to any disclaimer, the term of this patent is extended or adjusted under 35 U.S.C. 154(b) by 0 days.

(21) Appl. No.: 09/487,615

(22) Filed: Jan. 20, 2000

(51) Int. Cl.[7] ..... B21B 13/14; B21B 31/07
(52) U.S. Cl. ..... 72/241.8; 72/241.2
(58) Field of Search ..... 72/241.2, 241.4, 72/241.8, 242.4, 243.4, 243.2, 243.6

(56) References Cited

U.S. PATENT DOCUMENTS

| | | | | |
|---|---|---|---|---|
| 2,169,711 | | 8/1939 | Sendzimir | 80/38 |
| 2,479,974 | | 8/1949 | Sendzimir | 80/38 |
| 2,776,586 | * | 1/1957 | Sendzimir | 72/242.4 |
| 3,628,362 | * | 12/1971 | Stone | 72/242.2 |
| 4,270,377 | | 6/1981 | Verbickas et al. | 72/242 |
| 5,218,852 | * | 6/1993 | Watanabe et al. | 72/241.4 |
| 5,638,716 | | 6/1997 | Jonen | 72/241.8 |
| 5,666,844 | * | 9/1997 | Bieber | 72/242.4 |
| 5,906,129 | | 5/1999 | Quambusch | 72/241.8 |
| 5,943,895 | | 8/1999 | Lemper | 72/241.4 |
| 5,943,896 | | 8/1999 | Rosenthal et al. | 72/252.5 |
| 5,964,116 | | 10/1999 | Bode et al. | 72/245 |

* cited by examiner

*Primary Examiner*—Rodney A. Butler
(74) *Attorney, Agent, or Firm*—William C. Crutcher

(57) ABSTRACT

Strip edge relief is adjusted in a twenty-high cluster rolling mill by a set of double-tapered intermediate rolls in contact with the work roll. Rolling forces bend the work roll ends toward the tapered sections of the intermediate rolls to provide strip edge relief. Hydraulic actuators rotatably contact journals on the intermediate rolls and exert bending forces bending forces which bend the intermediate rolls so as to bending in the work rolls. This adjusts the strip edge relief.

12 Claims, 6 Drawing Sheets

METHOD AND APPARATUS FOR CONTROLLING STRIP EDGE RELIEF IN A CLUSTER ROLLING MILL

Figure 1:
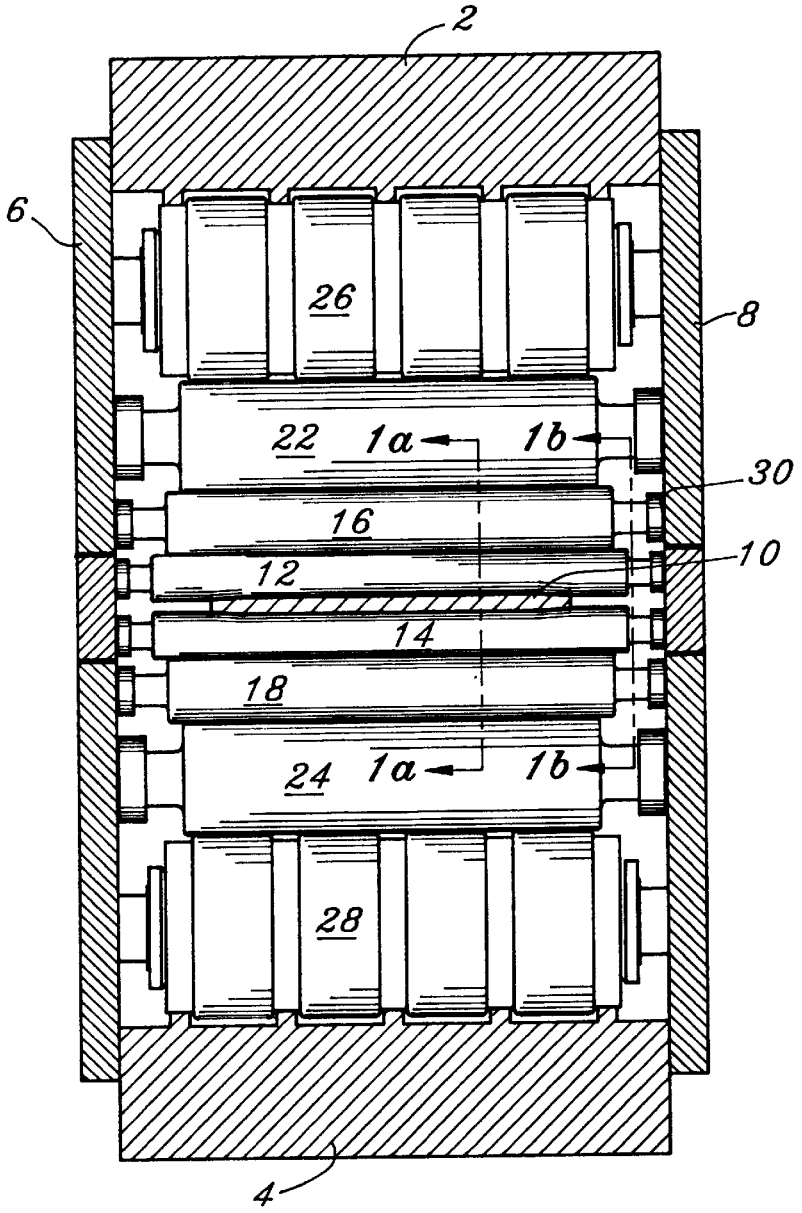
Fig. 1 (Prior Art)

This invention relates generally to cluster rolling mills for rolling cold metal strip, and more particularly to an improved method and apparatus for adjusting the strip edge relief in the edge region of the material being rolled.

BACKGROUND OF THE INVENTION

It is known that rolls in a rolling mill flatten slightly due to rolling forces imposed on the working rolls and intermediate rolls as they are squeezed between the backing bearings and the material being rolled. Since the width of the strip material being rolled is always less than the length of the working rolls, the ends of the working rolls are not flattened by these forces and there is a transition area extending inward from the edge of the strip being rolled. This transition section causes the edges of the strip to be over-rolled at the edges. This is because the distance between the flattened work rolls in the central portion of the strip is greater than the distance between the partially flattened work rolls at the edge of the strip. A strip that is over-rolled at the edges will result in wavy or "pie crust" edges.

The prior art has sought to control the polarity of the rolled material in various ways, for instance by controlling the surface profile of the work rolls and intermediate rolls, by controlling the surface profile of the backup bearing rolls through hydraulic cylinders actuating eccentric shaft mounting, or by selective bending of rolls.

Currently, a popular method for adjusting the strip edge relief in a twenty-high cluster rolling mill is to employ a pair of intermediate rolls in contact with the upper work roll which are tapered on one end, and a pair of intermediate rolls in contact with the lower work roll, which are tapered on the other end. Then, by selectively shifting one or the other of the sets of tapered rolls in a lateral direction, using rotating couplings and linkage rods attached to hydraulic actuators, the degree of strip edge relief may be adjusted. The disadvantage of this system is that the rotating couplings must be small in diameter in order to function. Therefore lateral adjustments of the tapered rolls may only achieved under light rolling loads.

Although the prior art system utilizing lateral adjustments of the single-end-tapered intermediate rolls is effective for controlling over-rolling of strip edges, the lateral shifting mechanisms required are complicated and expensive. Also removal and replacement of the single-end-tapered intermediate rolls is cumbersome and time consuming.

Accordingly, one object of the present invention is to provide an improved method and apparatus for controlling strip edge relief in a cluster rolling mill.

Another object of the invention is to provide an improved method and apparatus for controlling polarity of strip material rolled in a twenty-high cluster rolling mill.

Still another object of the invention is to provide an improved method and apparatus for utilizing tapered intermediate rolls to adjust strip edge relief, without requiring lateral adjustment of the tapered rolls.

SUMMARY OF THE INVENTION

Briefly stated, the present invention comprises an improved apparatus and method for controlling strip edge relief in a cluster rolling mill, the cluster rolling mill comprising first and second work rolls for contacting material to be rolled, first and second pairs of intermediate rolls contacting the respective first and second work rolls, and a number of additional rolls and backing bearings providing backing support for the intermediate rolls in first and second clusters mounted in a supporting frame.

The improved apparatus is characterized by each roll of the first pair of intermediate rolls being double-tapered, and having a central portion contacting the first work roll, tapered portions on opposite sides of the central portion providing gradually increasing clearance with the first work roll, and having journal portions on opposite ends thereof together with means arranged to rotatably engage the opposite journal portions of the first pair of intermediate rolls and adapted to controllably exert bending forces on the first pair of intermediate rolls so as to adjust the strip edge relief on the material rolled between the first and second work rolls.

The improved method comprises providing a first pair of double-tapered intermediate rolls as described above, rotatably engaging the opposite journal portions and controllably exerting bending forces on the first pair of intermediate rolls so as to adjust the strip edge relief on the material being rolled between the first and second work rolls.

DRAWING

The invention will be better understood by reference to the following description, taken in connection with the accompanying drawings, in which:

FIG. 1 is a schematic end elevational view of a hypothetical rolling mill, illustrating the problem of "over-rolling" the edges of strip material due to work roll flattening.

Figure 1A:
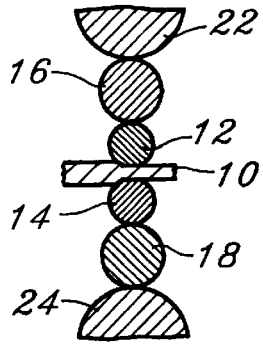
Figure 1B:
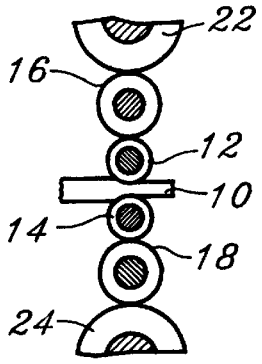
Figure 2A:
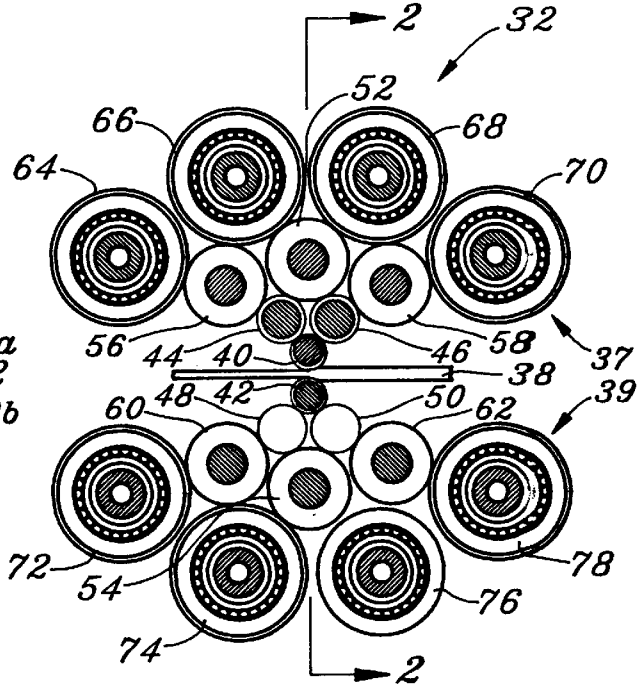
Figure 2:
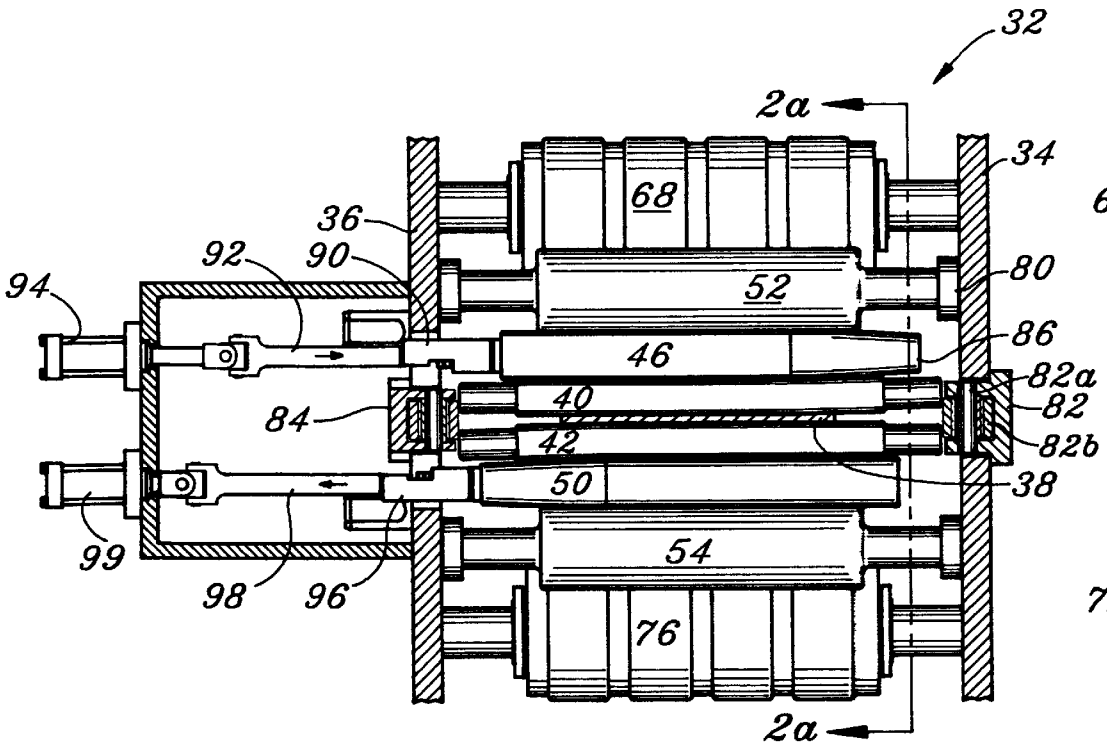
Fig.2 (Prior Art)
Figure 3:
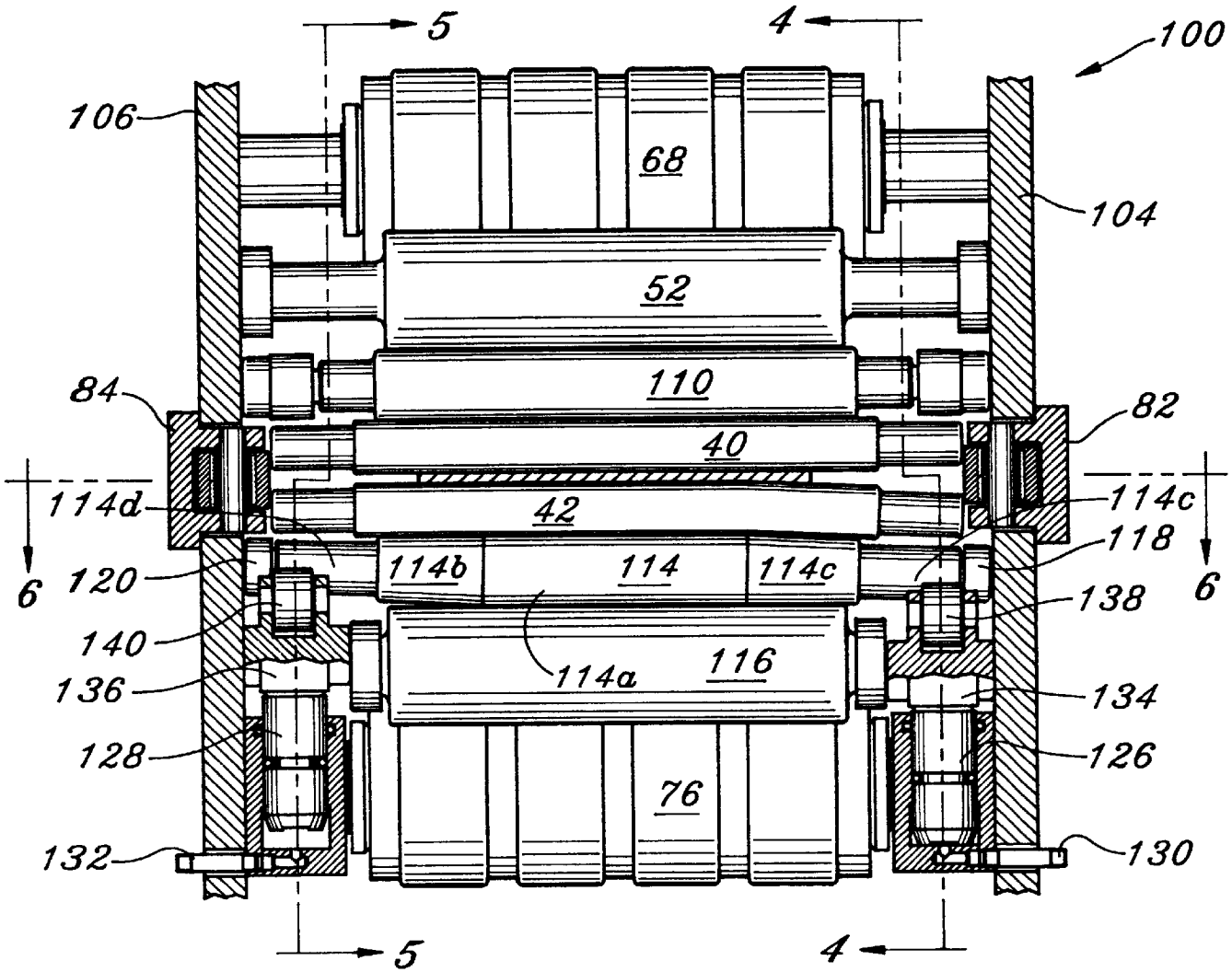
Figure 4:
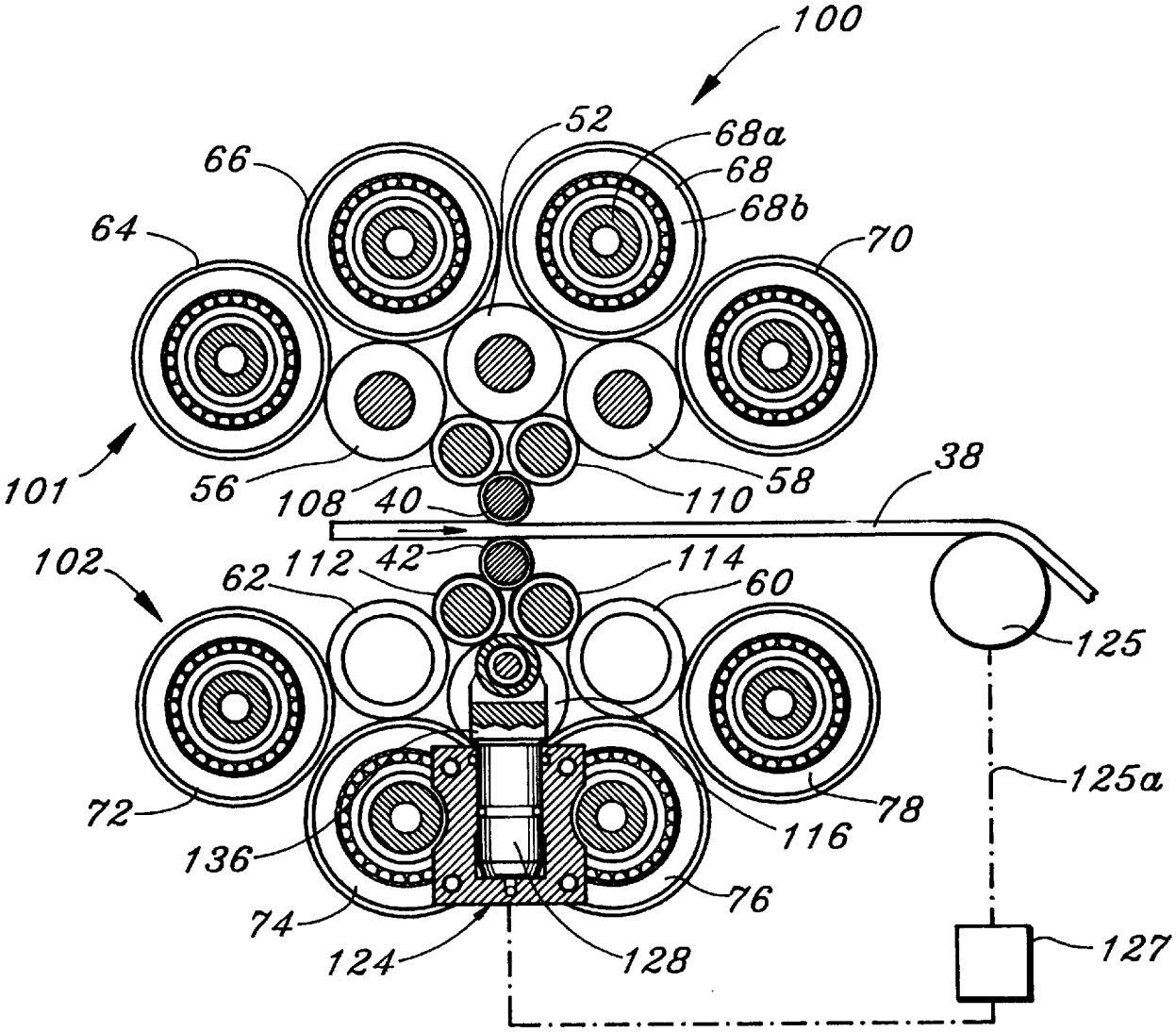
Figure 5:
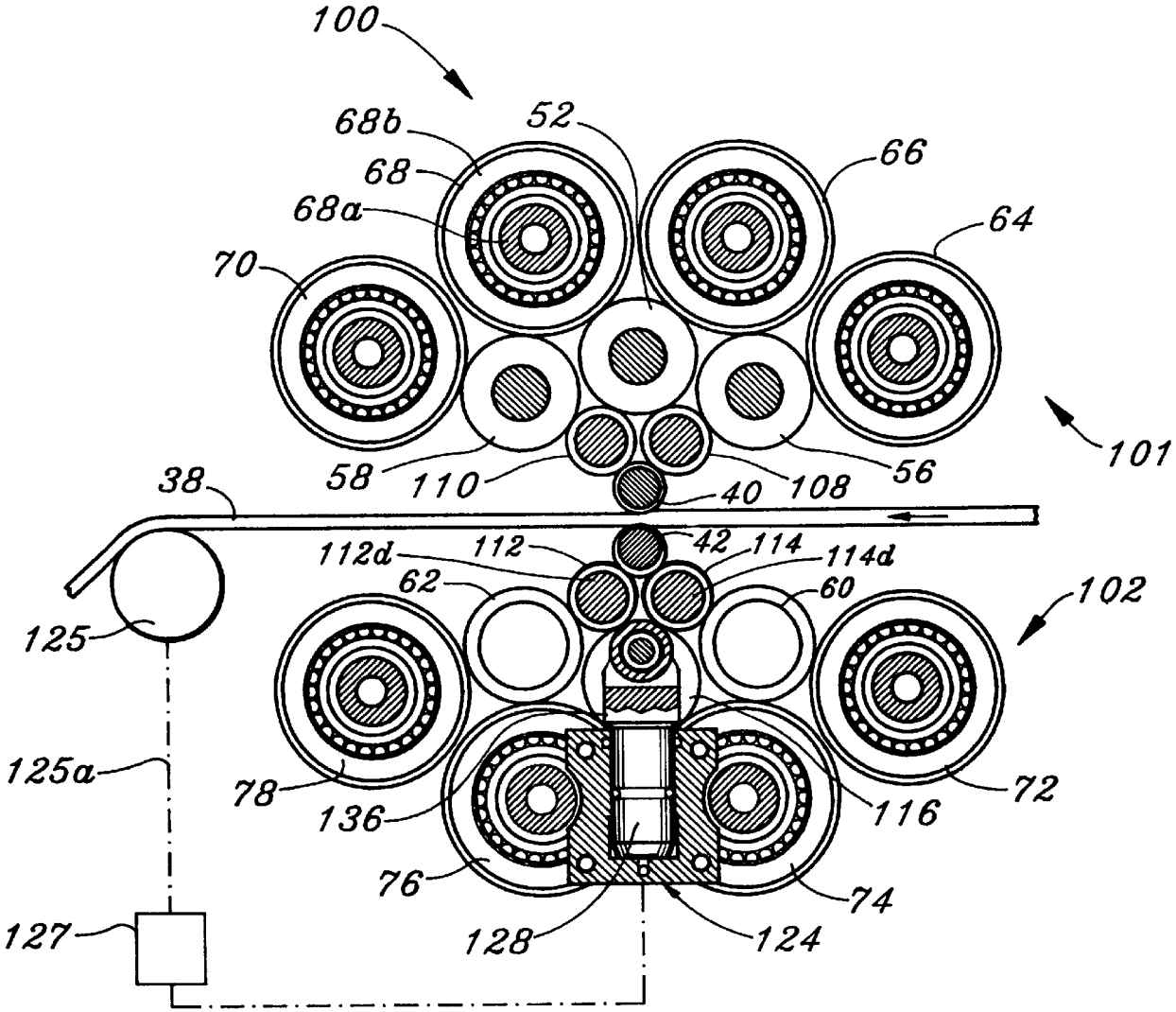
Figure 6:
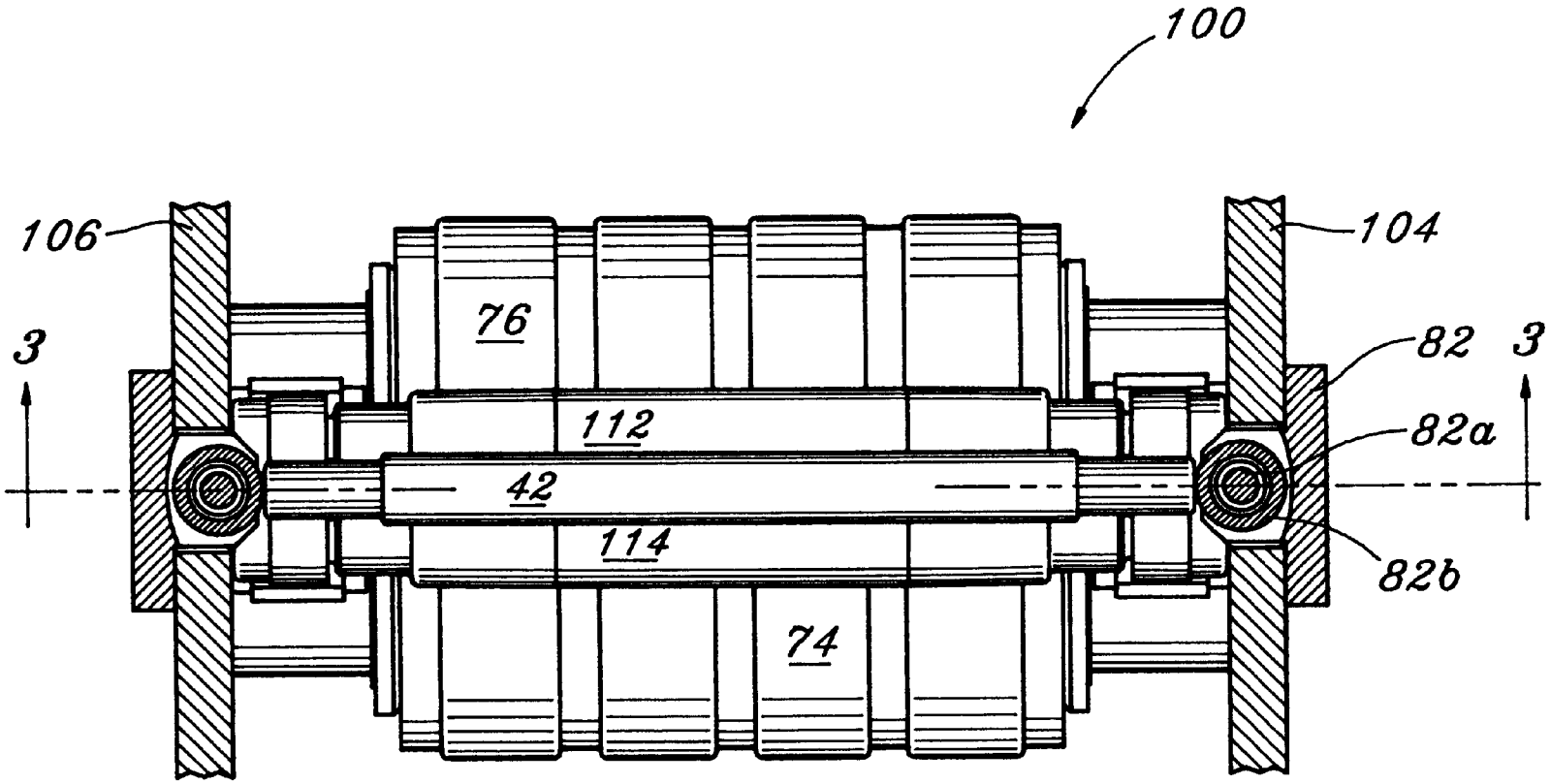

FIG. 1*a* is a schematic partial side elevational view, in cross section, taken along lines 1*a*—1*a* of FIG. 1, FIG. 1*b* is a schematic partial side elevational view, in cross section, taken along lines 1*b*—1*b* of FIG. 1, FIG. 2 is a schematic end elevational view, in cross section, taken through the center line 2—2 of a prior art, twenty-high, cluster rolling mill, FIG. 2*a* is a schematic side elevational view, in cross section, taken along lines 2*a*—2*a* of FIG. 2, FIG. 3 is a schematic end elevational view, in cross section, taken through the extended vertical plane 3—3 shown in FIG. 6, FIG. 4 is a schematic side elevational view, in cross section, taken along lines 4—4 of FIG. 3, looking in the direction of the arrows, FIG. 5 is a schematic side elevational view, in cross section, taken alone lines 5—5 of FIG. 3, looking in the direction of the arrows, and FIG. 6 is a schematic top plan view, in cross section, taken along lines 6—6 of FIG. 3, looking in the direction of the arrows.

Referring now to FIG. 1 of the drawings showing a prior art rolling mill having an outer supporting frame (not shown) in which are mounted upper and lower bearing enclosures 2, 4 and side door plates 6, 8. A strip 10 of work material is shown being cold-rolled to reduce its thickness. Enclosed within bearing enclosures 2, 4 and side door plates 6, 8 are upper and lower work rolls 12, 14 respectively, backed up by upper and lower intermediate rolls 16, 18 respectively, and rolling the strip of material 10.

FIG. 1 is shown only in schematic view to illustrate the problem of the prior art, and is not intended to depict any particular type of rolling mill. The intermediate rolls 16, 18 are backed up by other intermediate rolls 22, 24 which, in turn, are restrained by bearings 26, 28 rotatably mounted in bearing enclosures 2, 4. Rolls 12–24 are rotatably mounted in roller thrust bearings, such as the one indicated at reference number 30 to permit vertical adjustment, as the strip material 10 is reduced in cross section. FIG. 1*a* and FIG. 1*b* are partial side elevational views, in cross section, showing the reduction of strip 10 as it passes between work rolls 12, 14.

As is seen in FIG. 1, the center portions of work rolls 12, 14 are flattened slightly during the rolling process, while the ends of work rolls 12, 14 beyond the strip material 8 remain round. This causes a transition of each side from a thicker cross section to a thinner cross section, termed "over-rolling". The resulting strip 10 will have wavy or "pie crust" edges.

Referring to FIG. 2 and FIG. 2*a*, a prior art twenty-high cluster rolling mill is shown generally at 32. The drawings are shown in schematic view only. The actual construction of a rolling mill includes the details of the supporting frame members. Details of the roller thrust bearings and slidable chocks supporting the rolls arc also omitted. The details of conventional construction in cluster rolling mills may be seen by reference to U.S. Pat. No. 2,169,711 issued Aug. 15, 1939, U.S. Pat. No. 2,479,974 issued Aug. 23, 1949, and U.S. Pat. No. 2,776,586 issued Jan. 8, 1957, all in the name of Thadeusz Sendzimir, which are incorporated herein by reference. Strip material 38 is shown being reduced in cross section between upper clusters 37 and lower clusters 39, made up of upper and lower work rolls 40, 42 respectively, upper intermediate rolls 44, 46 in contact with upper work roll 40 and lower intermediate rolls 48, 50 in contact with lower work roll 42; an upper idler roll 52 in contact with both of the pair of intermediate rolls 44, 46, a lower idler roll 54 in contact with both of the pair of lower intermediate rolls 48, 50, upper drive rolls 56, 58 in contact with intermediate rolls 44, 46 respectively, lower drive rolls 60, 62, in contact with lower intermediate rolls 48, 50 respectively, upper backing bearings 64, 66, 68, 70 contacting the idler roll 52 and the drive rolls 56, 58 as indicated in FIG. 2*a* of the drawing, and lower backing bearings 72, 74, 76, 78 contacting the idler roll 54, and the drive roll 60, 62, as indicated in the drawing.

Rolls 56, 58, 60 and 62 are designated "drive rolls" for convenience. They may be driven in some mills by suitable means, or they may not be driven at all if the material passing through the rolls supplies the driving torque on the rolls. Whether the drive rolls are driven or not is not relevant to the invention.

The backing bearings 64–78 are rotatably mounted, as indicated by the representative backing bearing 68, on shafts, such as shaft 68*a* supported in rings 68*b*, located on both sides of each backing bearing 64–78. The rings 68*b* are supported by chocks (not shown) vertically adjustable in the main supporting frame (not shown). Idler rolls 52, 54 are provided with roller thrust bearings 80 and are supported in slidable chocks (not shown) so as to move vertically. Work rolls 40, 42 being very small in diameter are free to float vertically and are restrained laterally by special bearings 82, 84. Each of the bearings 82, 84 includes a vertical pin 82*a* serving as a journal for a roller bearing 82*b*. The ends of work rolls 40, 42 are free to rotate while being restrained laterally by the roller bearing 82*b*.

Strip edge relief is accomplished in the prior art rolling mill 32 as follows. The upper intermediate rolls 44, 46 are provided with single tapered end sections 86. The lower intermediate rolls 48, 50 are provided on the opposite end with single tapered end sections 88. Rolling forces on the strip 38 cause the upper work roll 40 to bend toward the tapered section 86 as shown on the right hand side of FIG. 2, and cause the lower work roll 42 to bend toward the tapered section 88 on the lower intermediate roll 50 as shown in the left hand side of FIG. 2. The degree of bending is exaggerated in the drawing to clearly illustrate the process. This relieves the strip edges on both sides of strip 38.

Adjustment of the strip edge relief is provided in the prior art rolling mill 32 by lateral movement of the single tapered intermediate rolls. The upper intermediate rolls 44, 46 are provided with rotating couplings 90 connected by linkage 92 to double-acting hydraulic actuators 94. The lower intermediate rolls 48, 50 are provided with rotating couplings 96, connected by linkages 98 to hydraulic actuators 99. Operation of the actuators 94, 99 will cause the single ended tapered intermediate rolls to slide laterally, thus controlling the degree of bending allowed to the work rolls 40, 42, and thus adjusting the strip edge relief. The problem with the prior art construction of FIG. 2 is that the rotating couplings 90, 96 are limited in size to correspond to the diameter of the intermediate rolls and therefore are limited in strength capacity. Therefore, the lateral adjustments of the intermediate rolls can be achieved only under light rolling loads due to sliding friction between the rolls. The rotating couplings and linkages required are complicated and expensive. Removal and replacement of the intermediate rolls is cumbersome and time consuming.

Referring now to FIGS. 3–6, the improved method and apparatus for controlling strip edge relief is illustrated in a twenty-high, cluster type rolling mill shown generally at 100 having an upper cluster 101 and a lower cluster 102 of rolls and backing bearings. The elements which are substantially identical to those in the prior art mill 32 discussed in connection with FIG. 2 are labeled with the same reference numerals. Elements which differ in construction are side plates 104, 106, upper intermediate rolls 108, 110, lower intermediate rolls 112, 114, and lower idler roll 116. These elements differ from their counterparts in FIG. 2 in the following respects. Upper intermediate rolls 108, 110 are cylindrical, rather than tapered on one end. Lower intermediate rolls 112, 114 are double tapered, i.e., have a central cylindrical portion 114*a* and tapered portions 114*b*, 114*c* on opposite sides of the central portion. The lower intermediate rolls also have journal portions 114*d*, 114*e* extending from opposite ends. Roller thrust bearings 118, 120 on opposite sides of lower intermediate rolls 112, 114 prevent lateral movement while allowing rotation. Lastly, the lower idler roll 116 is shorter in length to allow space for hydraulic actuators.

In accordance with the present invention, hydraulic actuators 122, 124 are attached to sidewalls 104, 106 respectively. These include pistons 126, 128, respectively, having the lower ends thereof exposed to hydraulic fluid supplied through individually controlled supply lines 130, 132. Supply lines 130, 132 are connected to a source of high pressure hydraulic fluid having conventional controls (not shown) for admitting or discharging hydraulic fluid to increase or decrease the hydraulic pressure forcing pistons 122, 124 upward. External strip shape measuring devices, such as the one shown at 125 provide signals 125*a* to control means 127 to automatically control the admission and discharge of hydraulic fluid to maintain the strip edge relief at a selected setting.

Affixed to the top of pistons 126, 128 are devises 134, 136 carrying casters 138, 140 respectively mounted on roller bearings. Casters 138, 140 are adapted to engage the journal portions 114*d* and 114*e* of the lower intermediate rolls 112, 114, as best seen in FIG. 5, when the pistons are moved upward. Further upward movement of pistons 126, 128, devises 134, 136 and casters 138, 140 will controllably exert bending forces on the intermediate rolls 112, 114. This is because the central portions 114*a* of the intermediate rolls are restrained by virtue of their placement with respect to the work roll and the drive rolls as seen in FIG. 5.

OPERATION

When the pistons are in the downward position, as indicated in the right hand side of FIG. 3 and in FIG. 4, the rolling forces tend to slightly bend the end of the work roll 42 toward tapered section 114*c*, as indicated in exaggerated form on the right hand side of FIG. 3. This gives relief on the strip edge, which would be thicker in cross section if not adjusted.

In accordance with the present invention, the strip edge relief is adjusted by admitting fluid through the hydraulic lines to controllably exert bending forces on the intermediate rolls. Preferably this is automatically controlled by signals from conventional strip edge thickness sensors. The central portions of intermediate rolls 112, 114 are restrained from moving by the central portions of the adjacent work roll 42 and drive rolls 60, 62. Upward force by the caster 140 on the journal portions 112*d*, 114*d* bends the intermediate rolls which tends to reduce the bend in the work rolls 42. This is illustrated on the left hand side of FIG. 3 and in FIG. 5, where the rollers 140 have engaged the journal portions 112*d*, 114*d* of the two lower intermediate rolls 112, 114, and forced them upward . The left end of the work roll 42 is moved toward the material being rolled, so as to adjust the strip edge relief and achieve polarity. Ideally, there should be a very slight over-rolling of the work piece edge.

The foregoing adjustment is provided without lateral shifting of the intermediate rolls as in the prior art. Instead of laterally shifting single tapered intermediate rolls located in both the upper and the lower clusters, the invention is carried out by bending double tapered intermediate rolls located only in the bottom cluster. Accordingly, there are simplifications in construction, lateral size of the overall mill dimension and reduced time to remove and replace the intermediate rolls. The amount of strip edge rolling is controlled by varying the hydraulic pressure to the pistons and can be achieved under all rolling loads, because there is no sliding friction between rolls as in the prior art. Since there are no other mechanisms connected to the intermediate rolls, removal is simple and quick. The upper intermediate rolls require removal only when they are worn or marked.

While the invention has been described in connection with a twenty-high rolling mill, the principal may be applied to other types of rolling mills, in which there are upper and lower clusters containing a work roll, and a pair of intermediate rolls contacting the work roll, the aforesaid rolls being restrained by other surrounding rolls in various configurations.

While the means for engaging the opposite journal portions and exerting bending forces on a double tapered intermediate roll has been illustrated using hydraulic actuators, other types of mechanisms such as sliding wedges, rack and pinion, eccentric bearings, etc. may be substituted for the hydraulic cylinders to controllably exert bending forces on the double tapered intermediate rolls. The tapered sections may be frusto-conical or they may be contoured. Also, while the double tapered intermediate rolls and hydraulic actuators are shown in the preferred arrangement on the bottom of the rolling mill functioning in the lower cluster, they could also be located in the upper cluster located in the upper part of the rolling mill. In some cases, it may be desired to obtain additional adjustment of strip edge relief. In this case, it is feasible to utilize double tapered intermediate rolls and hydraulic actuators on the upper pair of intermediate rolls as well as on the lower pair.

The word "strip" as used throughout the specification and claims may sometimes be called "sheet" in rolling mills; and the use of the word strip is not intended to be limiting, as to the thickness of the material being rolled.

While there has been shown what is considered to be the preferred embodiment of the invention, it is desired to cover in the appended claims all such modifications as fall within the true spirit and scope of the invention.

What is claimed is:

1. Improved apparatus for controlling strip edge relief in a cluster rolling mill of the type having first and second clusters of mutually interacting rolls and backing bearings rotatably mounted in a supporting frame, said rolls including first and second work rolls for contacting material to be rolled, and first and second pairs of intermediate rolls contacting the respective first and second work rolls, said first and second pairs of intermediate rolls having central portions which are restrained by the remaining rolls and backing bearings disposed in the first and second clusters respectively while rolling said material, the improved apparatus characterized by:

each roll of said first pair of intermediate rolls having a central portion contacting the first work roll, tapered portions on opposite sides of the central portion providing gradually increasing clearance with the first work roll, and having journal portions on opposite ends thereof, and roll bending means arranged to rotatably engage the opposite journal portions of said first pair of intermediate rolls and controllably exert bending forces on the intermediate rolls so as to adjust the strip edge relief on the material rolled between the first and second work rolls.

2. The combination according to claim 1, wherein said roll bending means includes a plurality of rotatable casters arranged to engage both said journal portions on one end of the first pair of intermediate rolls.

3. The combination according to claim 1, wherein said roll bending means includes hydraulic actuators arranged to exert said bending forces on opposite ends of the first pair of intermediate rolls.

4. Improved method for controlling strip edge relief in a cluster rolling mill of the type having first and second clusters of mutually interacting rolls and backing bearings rotatably mounted in a supporting frame, said rolls including first and second work rolls for contacting material to be rolled, and first and second pairs of intermediate rolls contacting the respective first and second work rolls, said first and second pairs of intermediate rolls having central portions which are restrained by the remaining rolls and backing bearings disposed in the first and second clusters respectively while rolling said material, the improved method comprising:

providing a first pair of intermediate rolls, each roll of said intermediate rolls having a central portion contacting the first work roll, tapered portions on opposite sides of the central portion providing gradually increasing clearance with the first work roll, and having journal portions on opposite ends thereof, and rotatably engaging the opposite journal portions of said first pair of intermediate rolls and controllably exerting bending forces on the intermediate rolls so as bend the intermediate rolls to adjust the strip edge relief on the material rolled between the first and second work rolls.

5. The method according to claim 4, including the step of increasing the bending forces until achieving substantial planarity of the material being rolled.

6. Improved apparatus for controlling strip edge relief in a known type of twenty-high cluster rolling mill, said rolling mill comprising a supporting frame, first and second work rolls for contacting material to be rolled, first and second pairs of intermediate rolls contacting the respective first and second work rolls, first and second idler rolls each contacting a respective first and second pair of intermediate rolls, a plurality of drive rolls each contacting a respective one of the intermediate rolls, and a plurality of backing bearings rotatably mounted in the supporting frame and contacting the drive rolls and idler rolls to provide backing support while rolling said material, the improved apparatus characterized by:

each roll of said first pair of intermediate rolls having a central portion contacting the first work roll, tapered portions on opposite sides of the central portion providing gradually increasing clearance with the first work roll, and having journal portions on opposite ends thereof, and roll bending means arranged to rotatably engage the opposite journal portions of said first pair of intermediate rolls and controllably exert bending forces on the intermediate rolls so as to adjust the strip edge relief on the material rolled between the first and second work rolls.

7. The combination according to claim 6, wherein said roll bending means includes a pair of rotatable casters, each said rotatable caster being arranged to engage both of said journal portions on one end of the first pair of intermediate rolls.

8. The combination according to claim 6, wherein said roll bending means includes a pair of hydraulic actuators arranged to exert said bending forces on opposite ends of the first pair of intermediate rolls.

9. The combination according to claim 6, wherein said roll bending means comprises first and second hydraulic actuators having movable pistons, first and second rotatable roller casters responsive to movement of the pistons of the respective actuators and arranged to engage the journal portions of both rolls of the first pair of intermediate rolls on opposite ends thereof, and means varying the hydraulic pressure in said hydraulic actuators while rolling material between the first and second work rolls.

10. The combination according to claim 6, wherein the second pair of intermediate rolls are substantially cylindrical without taper.

11. The combination according to claim 6, wherein both the first and second pairs of intermediate rolls are constructed as defined for the first pair, and wherein there is an additional roll bending means arranged to cooperate with the second pair of intermediate rolls to exert bending forces thereon to further adjust the strip edge relief.

12. The combination according to claim 6, including at least one sensor providing a signal responsive to variations in strip edge relief, and control means adjusting the strip edge relief in response to said signal.

* * * * *